United States Patent [19]

Blott et al.

[11] 4,067,770

[45] Jan. 10, 1978

[54] CONDITIONER BOX GUIDES

[75] Inventors: John Blott; William Chegwin; Walter Mann, all of Winnipeg, Canada

[73] Assignee: Plasma & Flame Coatings Ltd., Winnipeg, Canada

[21] Appl. No.: 659,720

[22] Filed: Feb. 20, 1976

Related U.S. Application Data

[63] Continuation-in-part of Ser. No. 538,400, Jan. 3, 1975, abandoned.

[51] Int. Cl.[2] ..... D21F 1/32; D21F 1/40; D21F 1/50

[52] U.S. Cl. ..... 162/274; 162/373; 162/374

[58] Field of Search ..... 162/199, 274, 278, 279, 162/373, 374

[56] References Cited

U.S. PATENT DOCUMENTS

| | | | |
|---|---|---|---|
| 3,250,671 | 5/1966 | Walker | 162/374 |
| 3,298,904 | 1/1967 | Le Compte | 162/279 X |
| 3,397,111 | 8/1968 | Rickert | 162/279 |
| 3,420,736 | 1/1969 | Kwasniewski et al. | 162/274 |
| 3,836,428 | 9/1974 | McConaughy | 162/279 X |
| 3,871,953 | 3/1975 | Lee et al. | 162/274 |

*Primary Examiner*—S. Leon Bashore
*Assistant Examiner*—Marc L. Caroff
*Attorney, Agent, or Firm*—Stanley G. Ade

[57] ABSTRACT

Felt belts normally used in paper making are conditioned after the newly formed paper is removed, by passing the belts over a narrow slot in a box under vacuum which extracts moisture and/or contaminants so that the belt is ready for reuse. Holders composed of a synthetic thermo-plastic are detachably secured to the top of the box with the holders detachably supporting steel rods covered with a hard ceramic coating which resists wear. The belt is supported by the rods and is drawn downwardly by vacuum into contact with an upper surface of the holders. Furthermore, the rods are designed to be repositioned when the coating does wear, in order to provide the use of more than one working surface thus extending the life of the rods.

1 Claim, 6 Drawing Figures

CONDITIONER BOX GUIDES

This is a continuation-in-part application of Ser. No. 538,400, filed Jan. 3, 1975, now abandoned.

BACKGROUND OF THE INVENTION

In conventional paper making processes, the paper is formed upon high speed endless belts which absorb the moisture to the extent where the sheet of partially formed paper can be separated from the belt and further processed. The felt belts are then normally passed over conditioning boxes which extract the moisture and any contaminants which may be on the belts, thus preparing the belts for further use immediately.

Felt conditioning boxes usually include an enclosure extending the full width of the belt, said enclosure being provided with a narrow transverse slot and a source of reduced air pressure or vacuum is connected to the box thus drawing air downwardly through the belt passing over the slot and removing the moisture at the same time.

The belt is supported and guided across the slot by stainless steel rods, but due to the high speed of the belt and the relative abrasive quality of the material used in the manufacture of the belts, the steel rods rapidly become worn and the sharp edges formed by this wear, initiates severe damage to the belts which are, of course, relatively expensive.

SUMMARY OF THE INVENTION

The present invention overcomes these disadvantages in several ways. Firstly, the stainless steel rods are covered with a hard ceramic material thus resisting wear and secondly, the rods are reversible within their holders so that when the ceramic coating is worn on one side, the rods can be reversed end for end and used for a further period. Alternatively, the rods can be moved to a plurality of positions so that a plurality of working surfaces can be provided.

Another advantage of the invention is to provide a device of the character herewithin described in which plastic holders are provided for the rods which can be used on boxes having either an arcuately curved upper surface or a planar upper surface.

A yet further object of the invention is to provide a device of the character herewithin described which, because the holders are made of plastic, enables a relatively narrow slot to be used thus increasing the vacuum action, with the belt being supported upon the upper surfaces of the rods and wearing the innermost sides of the holders to take up the curvatures of the belt which is drawn downwardly slightly at the slot by the vacuum being applied thereto.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
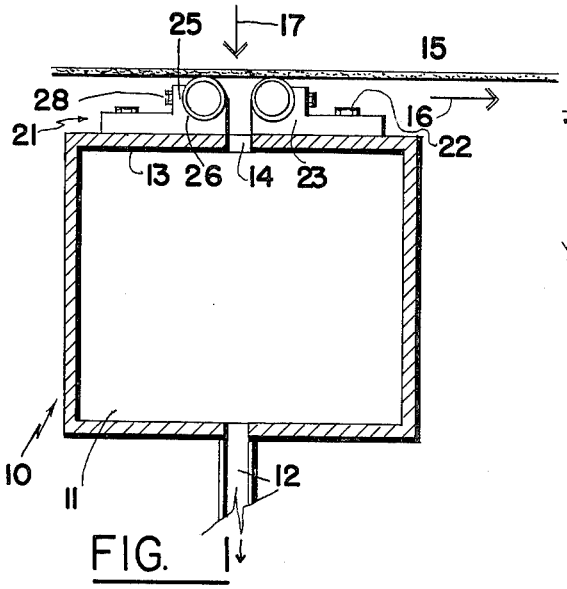
FIG. 1 is a cross sectional partially schematic view of the invention situated upon a felt conditioning box.

Proceeding therefore to describe the invention in detail, reference character 10 illustrates in cross section, a conventional conditioning box shown schematically and consisting of an enclosure 11, being connected to a source of reduced air pressure or vacuum, by means of connection 12.

Extending across the upper side 13 of the box is a relatively narrow slot 14, it being understood that this slot extends from one end to the other of the box which is the width of the felt belt 15 passing thereover and it should also be appreciated that the belt and box may be anywhere from 12 to 30 feet in width, depending upon the design of the paper making machinery being used.

The belt, which is an endless belt, travels at a fairly high speed in the direction of arrow 16 and passes over the slot so that air is drawn downwardly in the direction of arrow 17, said air passing through the belt immediately over slot 14 so that any moisture or the like is drawn from the belt which is then ready for further use.

Figure 6:
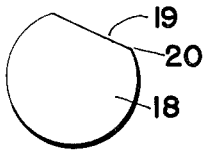
FIG. 6 is an enlarged end view of a conventional rod showing, in exaggerated form, the wear which normally takes place.

Stainless steel rods 18 (see FIG. 6) are normally used to support the belt as it passes over slot 14, but due to the abrasive quality of the belt and the high speed, the belt engages the rod and wears same into a flattened configuration as indicated by reference character 19 and the sharp corners 20 formed by this flattened portion damage the underside of the belt.

In the present invention, elongated plastic guide rod supports 21 are provided and are secured to the side 13 of the box by means of bolts 22 or the like, it being understood that there is a support 21 upon either side of the slot 14 as clearly shown.

Figure 2:
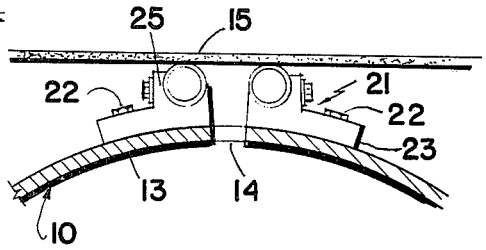
FIG. 2 shows a cross sectional view of the upper portion of an alternative conditioning box with the invention secured thereto.
Figure 3:
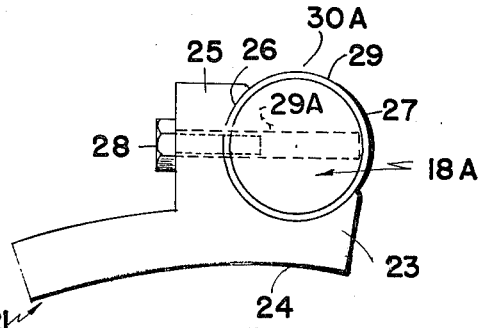
FIG. 3 is an enlarged fragmentary isometric view of one of the holders with the improved support rod in place.
Figure 4:
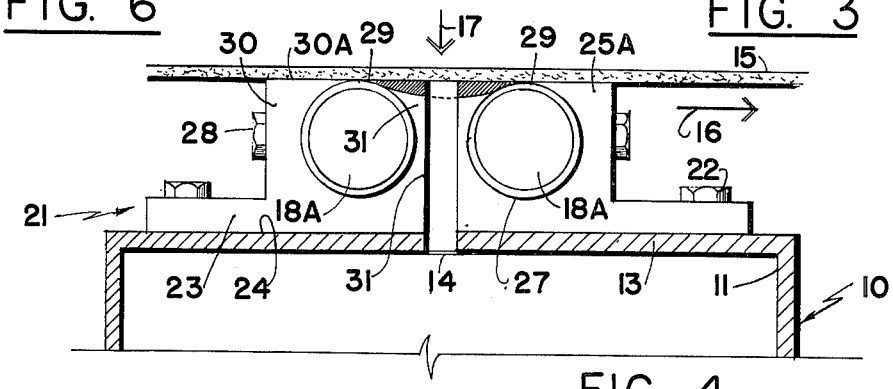
FIG. 4 is a cross sectional view of a further embodiment of the holders.

The upper side 13 of the felt conditioning box 10 may be either planar as shown in FIG. 1, or curved as shown in FIG. 2 and the preferred construction of the holder is shown in FIG. 3 in which the base portion 23 of the holder is provided with an arcuately curved under surface 24 having a curvature similar to the curvature of the side 14 of the box illustrated in FIG. 2. If, however, the holders are to be used on a box with a planar side 13 as shown in FIGS. 1 and 4, then the plastic holder can be provided with a flat base thus making the underside planar so that it can be secured to the planar side 13 as shown in FIGS. 1 or 4.

An upstanding portion 25 is provided upon the base portion 23 and the front side 26 of this planar portion is semi-cylindrically curved and blends into the upper side of the base portion 23 thus forming a semi-cylindrical pocket within which the guide rod 18A of the present invention may rest.

In the preferred embodiment, the holders are formed from rigid polyvinyl chloride plastic but of course any suitable thermoplastic may be used. Alternatively the holders can be manufactured from plastic impregnated glass fiber but this is a relatively expensive material to use in this application.

The guide rod or the like 18A is preferably manufactured from stainless steel and is cylindrical in cross section and is covered with a ceramic coating 27 thus providing a relatively friction free extremely hard surface to the guide rod. However, the term "rod" includes both cylindrical and square cross sectioned members as, for example, shown on the left hand side of FIG. 5. The rod can of course be manufactured from steel other than stainless steel but stainless steel is preferred in order to prevent corrosion of the steel surface occuring which can weaken the bond between the ceramic coating and the steel.

The ceramic coating is applied by conventional flame coating techniques and apparatus and may be either plasma flame sprayed or thermo flame sprayed depending upon the ceramic powders used and the design perameters.

The preferred application utilizes a base coat of Nickel Aluminide sprayed on the rod to a thickness of approximately 0.004 inch and a finish coat of Titanium Dioxide sprayed on to a thickness of approximately 0.030 inch. However other ceramic powders can be used if desired to form the relatively hard ceramic coating. For example a Tungsten Carbide powder can be used or an Alumina powder which consists of mostly Aluminum Oxide can be utilized.

Another well known ceramic coating powder is Alumina Titania which is constituted from appoximately 40 % Titanium Dioxide and approximately 60 % Aluminum Oxide.

The guide rod 18A is normally held within the pocket by means of a plurality of bolts 28 extending through the upstanding portion 25 and screw threadably engaging an aperture 29A formed through the rod 18A diametrically. This means that when the ceramic coating 27 does wear, the rod can be moved to present an unworn ceramic surface to the belt 15 being guided thereby.

The upper curved portion 29 of the guide rod 18A extends slightly above the plane of the upper surface 30 of the upstanding portion 25 so that the felt belt 15 is supported upon the two rods, one upon either side of the slot 14 as clearly shown in FIG. 1 and FIG. 2.

Figure 5:
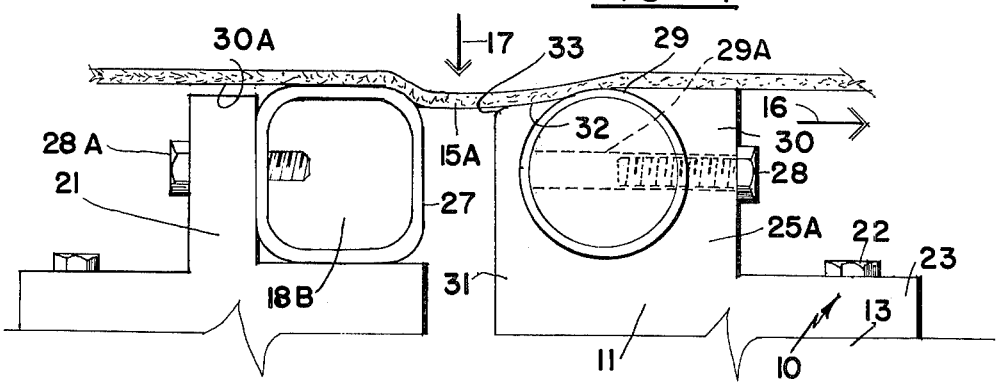
FIG. 5 is an enlarged fragmentary cross sectional view showing the advantages accruing from the construction shown in FIG. 4.

The preferred formation of the upper porton 25 is shown in FIGS. 4 and 5, and this upstanding portion is indicated by reference character 25A.

However, the upstanding portion 25A is provided with the semi-cylindrical pocket inset within the upstanding portion and the base portion, thus dividing the upstanding portion into an outer side 30 and a slot bounding side 31 as clearly shown in FIG. 4. The guide rods 18A are held within the pockets formed in the holders with the upper surfaces 29 extending slightly above the plane of the upper surface 30A of the upstanding portions.

This means that the bounding sides 31 of the slot 14 are relatively narrow thus concentrating the suction upon the portion of the belt passing thereabove.

This suction tends to draw down the portion 15A of the belt passing across the slot 14 as shown in FIG. 5 and this wears the relatively soft plastic to the curve illustrated by reference character 32 in FIG. 5 thus forming a smooth transitional curve from the upper surface 29 of the guide rods to the inner corners 33 of the bounding portion 31. This maintains a relatively narrow gap of the slot 14 and assists in maintaining good suction through the portion 15A of the belt passing thereacross. Once again the rods 18A shown in FIGS. 4 and 5 can be reversed when the upper surface portions 29 wear.

Reference should be made to FIG. 5 in which a square cross sectioned rod 18B is illustrated formed from stainless steel tubing or the like and covered with a ceramic coating similar to the coating 27. This is secured within a right angulated pocket by bolts 28A and may also be reversed or turned end for end as hereinbefore described with reference to the cylindrical rods 18A.

In the drawings, the rod 18 is shown with a construction which permits it to be reversed end to end in order that a new working surface is presented. However, it should be appreciated that other holes could be provided or other fastening means used, which will permit a plurality of working surfaces to be used when wear takes place.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention is:

1. In a felt conditioner box used in the manufacture of paper, said box being connected to a vacuum means and having an elongated air entrance slot extending across one side thereof with a felt belt travelling across said slot; the improvement comprising a guide rod on each side of said slot with an upper portion of each rod supporting the belt passing thereacross, and guide rod support means detachably secured to said box on each side of said slot, said guide rod support means including a rod receiving pocket formed therein and means extending through said guide rod support means to detachably hold said guide rod in said pocket, said guide rod support means being composed of a synthetic thermo-plastic, said guide rod comprising a stainless steel rod and a relatively thin, hard, wear-resistant ceramic coating bonded to said rod by flame spray coating application, said guide rod being detachably held in said pocket selectively in one of two alternate positions, namely a first position and a second position end to end reversed from said first position, thereby presenting an alternate surface for supporting said belt, said guide rod support means including an arcuately curved base and an unstanding portion upon said base having an upper surface, said pocket being formed within said upstanding portion, thereby dividing said upstanding portion into an outer side and a slot bounding side, the upper portion of said rod extending above the upper surface of said upstanding portion but being sufficiently closely spaced relative to one another so that said belt, is supported by said upper portion of said rod and is drawn downwardly by said vacuum means into contact with said slot bounding side.

* * * * *